US005118013A

United States Patent [19]

Mutou et al.

[11] Patent Number: 5,118,013

[45] Date of Patent: Jun. 2, 1992

[54] CYLINDRICAL TONER CARTRIDGE FOR ELECTROPHOTOGRAPHIC PRINTER

[75] Inventors: Eisaku Mutou; Kiyoshi Matsuda, both of Tokyo, Japan

[73] Assignee: Oki Electric Industry Co., Ltd., Tokyo, Japan

[21] Appl. No.: 599,395

[22] Filed: Oct. 19, 1990

[30] Foreign Application Priority Data

Oct. 19, 1989 [JP] Japan ..... 1-122439

[51] Int. Cl.[5] ..... B67D 5/64

[52] U.S. Cl. ..... 222/171; 222/DIG. 1

[58] Field of Search ..... 222/169, 171, 575, DIG. 1

[56] References Cited

U.S. PATENT DOCUMENTS 3,618,826 10/1971 Kangas et al. ..... 222/DIG. 1

4,441,636 4/1984 Yamashita et al. ..... 222/DIG. 1

FOREIGN PATENT DOCUMENTS 9001180 5/1989 World Int. Prop. O. .... 222/DIG. 1

*Primary Examiner*—Kevin P. Shaver

*Assistant Examiner*—Gregory L. Huson

*Attorney, Agent, or Firm*—Wenderoth, Lind & Ponack

[57] ABSTRACT

A toner cartridge has an outer cylinder and an inner cylinder contained in the outer cylinder in such a relation that it is adjacent to the outer cylinder and rotatably slidable relative thereto. Outer cylinder toner discharge openings are formed in the outer cylinder and spaced in the longitudinal direction thereof. Inner cylinder toner discharge openings are formed in the inner cylinder and spaced in the longitudinal direction thereof, the inner cylinder toner discharge openings being alignable with the outer cylinder toner discharge openings. Opposite ends of the outer cylinder are provided with notches. The outer cylinder toner discharge openings are spaced by at least one outer cylinder rib. The inner cylinder toner discharge openings are spaced by at least one inner cylinder rib which is not axially aligned with the outer cylinder rib.

16 Claims, 5 Drawing Sheets

CYLINDRICAL TONER CARTRIDGE FOR ELECTROPHOTOGRAPHIC PRINTER

BACKGROUND OF THE INVENTION

1. Field of the Invention

The present invention relates to a toner cartridge for an electrophotographic printer or the like, and more particularly to a toner cartridge comprising an outer cylinder and an inner cylinder which is slidably contained in the outer cylinder.

2. Description of the Prior Art

There is known a toner cartridge comprising an outer cylinder having outer cylinder apertures formed at opposite ends thereof and an inner cylinder contained in the outer cylinder in such a relation that it is adjacent to the outer cylinder and rotatably slidable relative thereto, which inner cylinder has inner cylinder apertures formed at opposite ends thereof. Such a conventional toner cartridge is shown in FIGS. 8–12.

As is apparent from FIGS. 8 and 9, the conventional toner cartridge is so arranged that an outer peripheral surface of an inner cylinder 7, including an inner cylinder rib 10, and an inner peripheral surface of an outer cylinder 2, including an outer cylinder rib 6, are relatively slidable over the entire peripheries thereof.

Referring to FIGS. 8 and 10, inner cylinder toner discharge openings 9 are closed by an inner wall of the outer cylinder 2. Thus, toner (not shown) filled into the inner cylinder 7 is not discharged therefrom. If it is required to discharge the toner from outer cylinder toner discharge openings 5, the inner cylinder 7 is slidably rotated relative to the outer cylinder 2 in the direction of an arrow A so that the inner cylinder toner discharge openings 9 are aligned partially with the outer cylinder toner discharge openings 5. If inner cylinder 7 is further rotated relative to the outer cylinder 2 in the direction of arrow A, the inner cylinder toner discharge openings 9 are aligned fully with the outer cylinder toner discharge openings 5, as shown in FIGS. 11–12, whereby there is obtained a fully opened condition. In such a condition, inner cylinder rib 10 is aligned with outer cylinder rib 6. If it is required to close the inner cylinder toner discharge openings 9, the inner cylinder 7 is rotated relative to the outer cylinder 2 in the direction of arrow B in FIG. 12, such that the inner cylinder toner discharge openings 9 are closed by the inner wall of the outer cylinder 2.

However, there is a problem with this toner cartridge arrangement. If the inner cylinder 7 or the outer cylinder 2 are deformed, it will be impossible to achieve a smooth sliding motion between the outer peripheral surface of the inner cylinder 7 and the inner peripheral surface of the outer cylinder 2, and such a deformation will lead to galling due to interference between such surfaces. Further, the conventional toner cartridge is so arranged that outer peripheral surfaces at opposite ends of the inner cylinder 7 and inner peripheral surfaces at opposite ends of the outer cylinder 2 are relatively slidable over the entire peripheries thereof. There also is a problem with this arrangement. If the outer cylinder 2 is deformed, it will be impossible to achieve a smooth sliding motion between the outer peripheral surfaces at opposite ends of the inner cylinder 7 and the inner peripheral surfaces at opposite ends of the outer cylinder 2, and such a deformation will lead to galling due to interference between such surfaces.

Furthermore, the conventional toner cartridge is so arranged that edges 9*a* of the inner cylinder toner discharge openings 9 and edges 5*a* of the outer cylinder toner discharge openings 5 are in parallel relation. There is a problem with this arrangement in that when the inner cylinder toner discharge openings 9 are closed, the respective edge portions may be overlapped. Thus, it may be impossible to fully close the inner cylinder toner discharge openings 9.

SUMMARY OF THE INVENTION

It is therefore an object of the present invention to provide a toner cartridge which solves the foregoing problems.

It is another object of the present invention to provide a toner cartridge which provides excellent slidability of the inner cylinder.

In accordance with a preferred embodiment, there is disclosed a toner cartridge comprising an outer cylinder that is generally cylindrical and hollow and having a peripheral surface in which are formed outer cylinder toner discharge openings that are spaced in the longitudinal direction of the outer cylinder. Apertures are provided at opposite ends of the outer cylinder. An inner cylinder that is generally cylindrical is positioned within the outer cylinder in such a relation that it is adjacent to the outer cylinder and is rotatably slidable relative thereto. The inner cylinder has a cavity in which may be contained toner. Apertures are provided at opposite ends of the inner cylinder and covers fit in the inner cylinder apertures. The inner cylinder has a peripheral surface in which are formed inner cylinder toner discharge openings spaced in the longitudinal direction thereof and communicating with the cavity. The inner cylinder toner discharge openings may be communicated with the outer cylinder toner discharge openings. The opposite ends of the outer cylinder are provided with notches. The outer cylinder toner discharge openings are spaced by a single or a plurality of outer cylinder ribs, and the inner cylinder toner discharge openings are spaced by a single or a plurality of inner cylinder ribs which are not aligned axially with the outer cylinder ribs.

In accordance with one embodiment of the invention, edges of the inner cylinder toner discharge openings extend at angles to edges of the outer cylinder toner discharge openings.

BRIEF DESCRIPTION OF THE DRAWINGS

The above and other objects and features of the present invention will become more apparent from the following detailed description, taken in conjunction with the accompanying drawings, in which.

DESCRIPTION OF THE PREFERRED EMBODIMENTS

Figure 1:
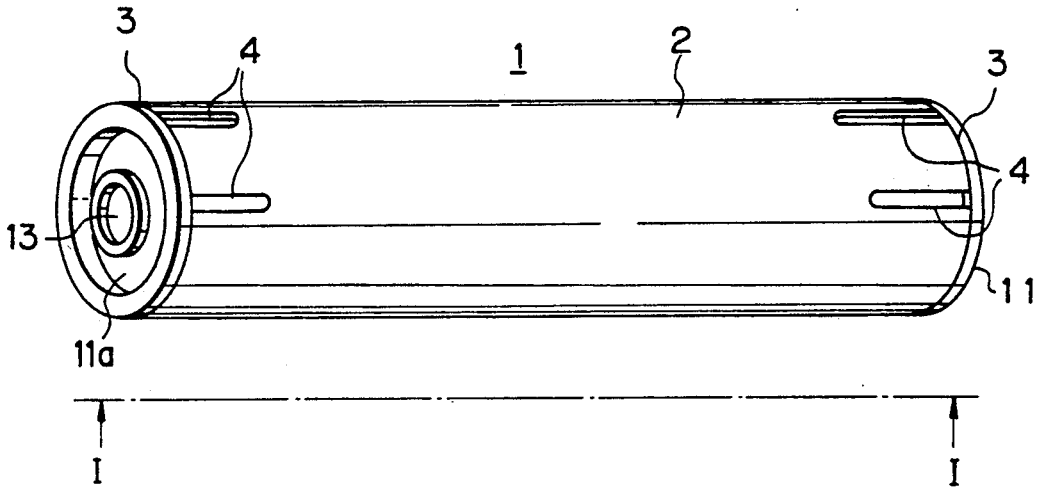
FIG. 1 is a perspective view of a preferred embodiment of a toner cartridge in accordance with the present invention.
Figure 2:
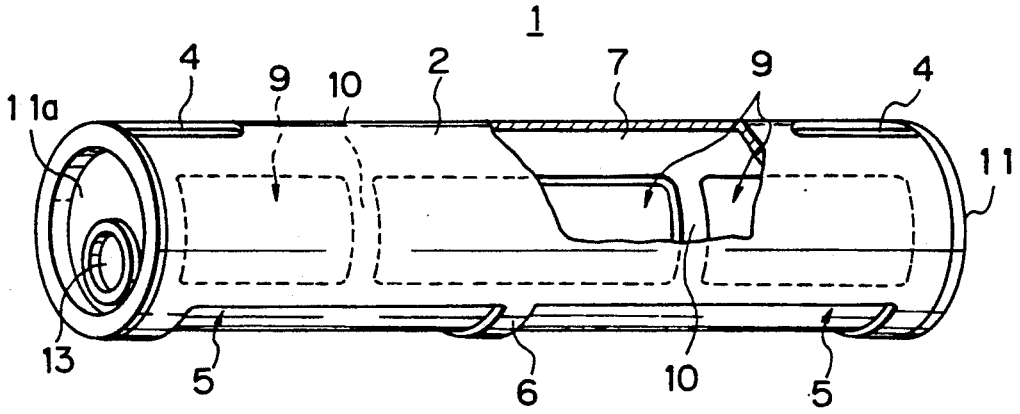
FIG. 2 is a partially cutaway view taken in the direction of the arrows substantially along the line I—I of FIG. 1.
Figure 3:
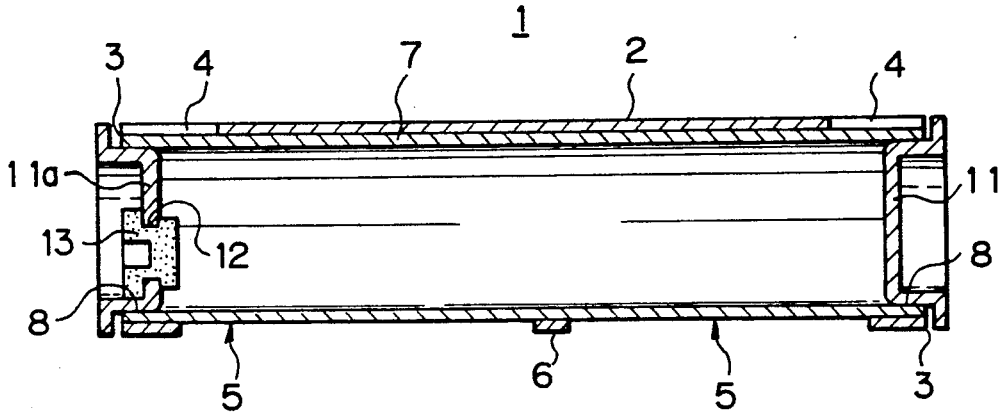
FIG. 3 is a longitudinal sectional view of the embodiment shown in FIG. 1.

A preferred embodiment of a toner cartridge of the invention will be described with reference to FIGS. 1—3, wherein like parts are denoted by like reference numbers.

A toner cartridge 1 is provided with an outer cylinder 2, which is generally cylindrical and hollow, and which extends in a longitudinal direction, as shown. Opposite ends of the outer cylinder 2 are provided with outer cylinder apertures 3 and a plurality of axially extending notches or slots 4 that are open at the respective axial end of the outer cylinder. Further, the outer cylinder 2 is provided with outer cylinder toner discharge openings 5 extending in and spaced in the longitudinal direction by an outer cylinder rib 6 located substantially at the center of the length thereof and extending in the peripheral direction of the outer cylinder 2.

An inner cylinder 7 is positioned within the outer cylinder 2 such that it is adjacent to the outer cylinder 2 and rotatably slidable relative thereto. The inner cylinder 7, which is also generally cylindrical and hollow and extends in the longitudinal direction, similar to the outer cylinder 2, is provided with inner cylinder apertures 8 at opposite ends thereof, each aligned with a respective outer associated cylinder aperture 3. The inner cylinder 7 is also provided with inner cylinder toner discharge openings 9 extending in and spaced in the longitudinal direction. The inner cylinder 7 is provided with inner cylinder ribs 10 each located approximately at a distance substantially equal to ¼ the total length of the inner cylinder toner discharge openings 9. Ribs 10 extend in the peripheral direction of the inner cylinder 7. In other words, inner cylinder ribs 10 are located at axial positions such that they may not be aligned with the outer cylinder rib 6.

A cover 11 is provided on and fit within one of the inner cylinder apertures 8, and a cover 11*a* is fit within the other aperture 8. The cover 11*a* is provided with a toner supply opening 12 and a cap 13 is detachably mounted in the toner supply opening 12.

In operation, if it is required to discharge toner (not shown) filled within the cavity of the inner cylinder 7, the inner cylinder 7 is slidably rotated relative to the outer cylinder 2 so that the inner cylinder toner discharge openings 9 are circumferentially aligned with the outer cylinder toner discharge openings 5. If it is required to stop the discharge of the toner, the inner cylinder 7 is slidably rotated relative to the outer cylinder 2 so that the inner cylinder toner discharge openings are closed by an inner wall of the outer cylinder 2.

Figure 4:
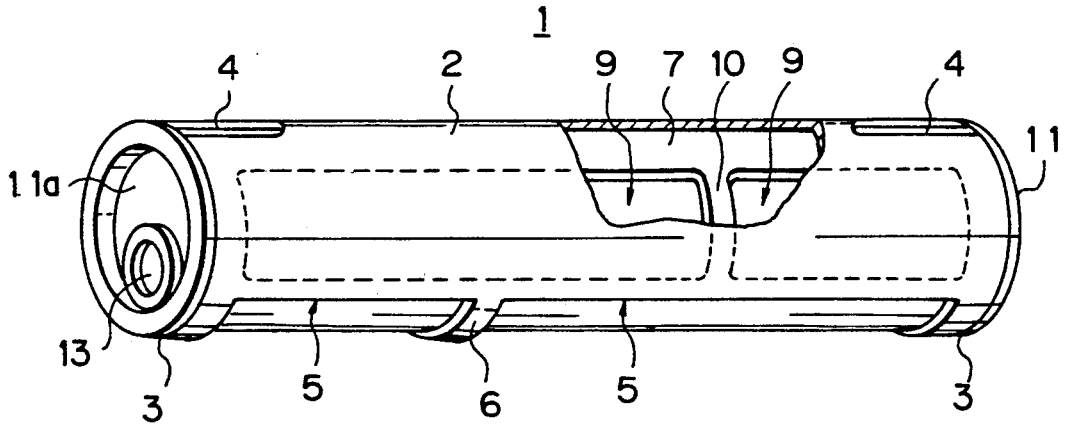
FIG. 4 is a partially cutaway view similar to FIG. 2 but of another embodiment.

As shown in FIG. 4, it may be arranged that the inner cylinder rib 10 is provided at a position shifted in one axial direction from the center of the length, while the outer cylinder rib 6 is provided at a position shifted in the opposite axial direction from the center of the length. As a matter of course, the precise axial positions and the numbers of the outer cylinder ribs 6 and the inner cylinder ribs 10 are not limited to the illustrated arrangements as long as the outer cylinder ribs 6 and the inner cylinder ribs 10 are not at the same axial positions.

Figure 5:
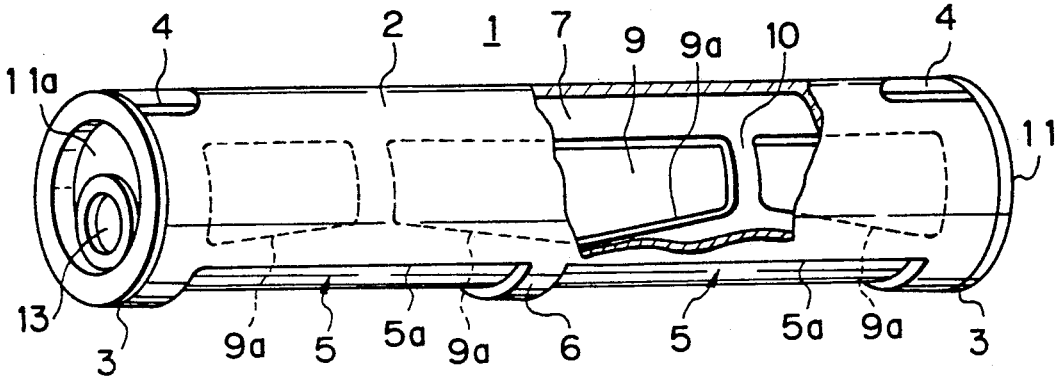
FIG. 5 is a view similar to FIGS. 2 and 4 but of a further embodiment.
Figure 6:
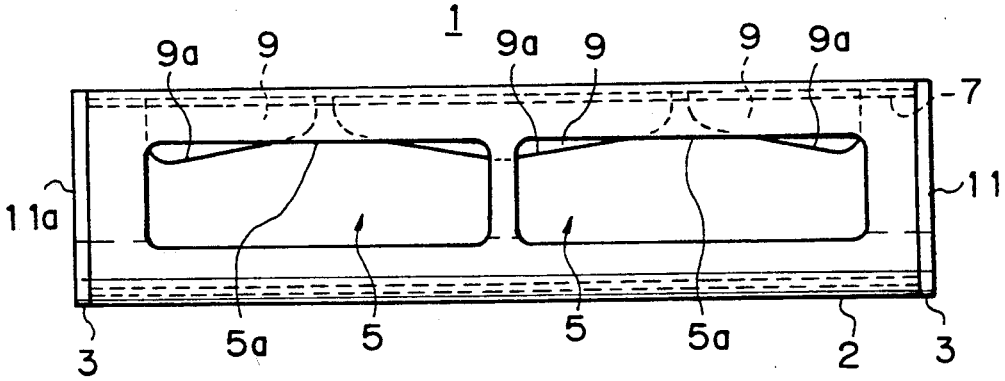
FIG. 6 is an elevational side view of such embodiment.

Further, as shown in FIG. 5, edges 9*a* of the inner cylinder toner discharge openings 9 at the circumferential side for sealing toner may be formed at angles with edges 5*a* of the outer cylinder toner discharge openings 5. According to such an arrangement, when the inner cylinder toner discharge openings 9 are closed by rotating the inner cylinder 7 relative to the outer cylinder 2, each edge 9*a* of the inner cylinder toner discharge openings 9 slides relative to a edge 5*a* of the outer cylinder toner discharge openings 5 at a single point of contact only, as shown in FIG. 6. Thus, it is possible to avoid such a situation that the edges 5*a* and 9*a* meet linearly over a substantial length. Thereby, the inner cylinder toner discharge openings 9 smoothly are closed.

Figure 7:
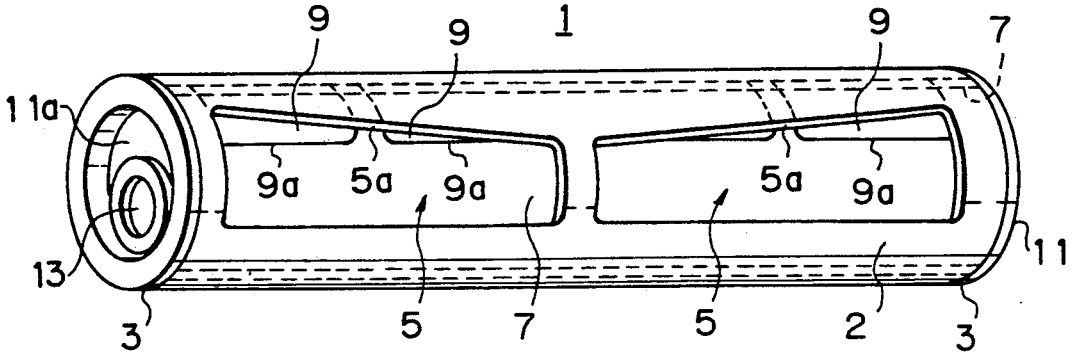
FIG. 7 is a view similar to FIG. 5 illustrating another embodiment.
Figure 8:
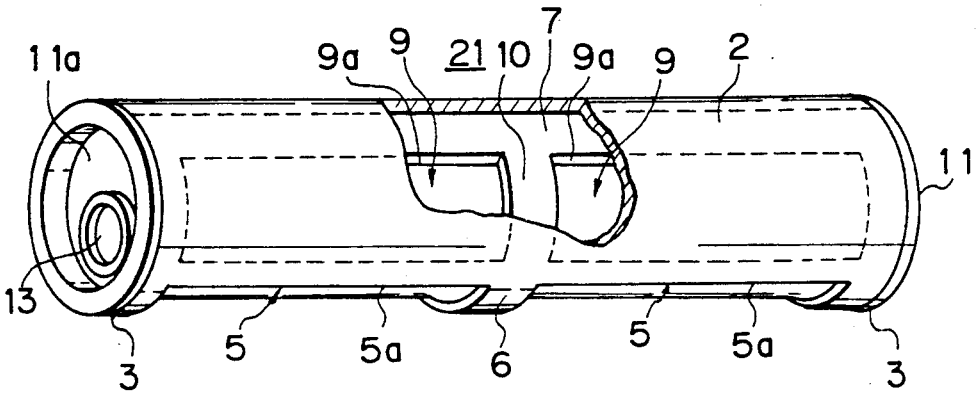
Fig. 8 PRIOR ART
FIG. 8 is a partially cutaway view in perspective of a conventional toner cartridge.
Figure 9:
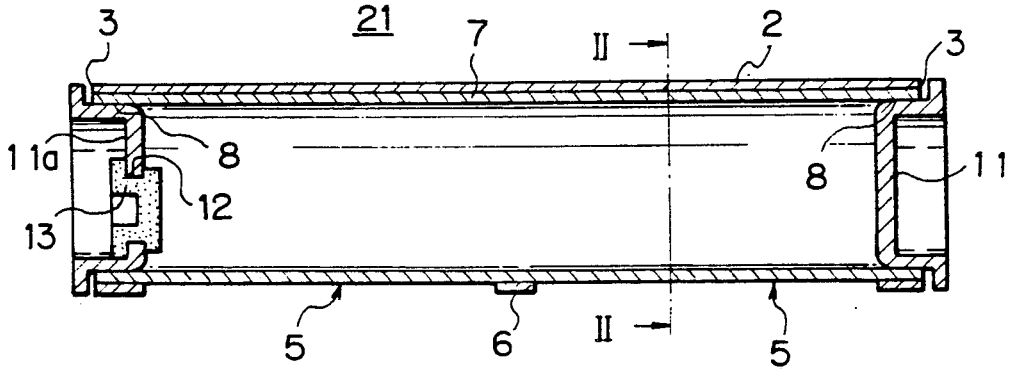
Fig. 9 PRIOR ART
FIG. 9 is a longitudinal sectional view of the conventional toner cartridge shown in FIG. 8.
Figure 10:
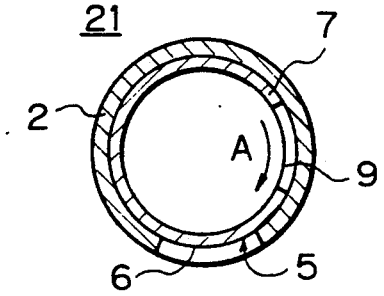
Fig. 10 PRIOR ART
FIG. 10 is a cross-sectional view taken on line II—II of FIG. 9.
Figure 11:
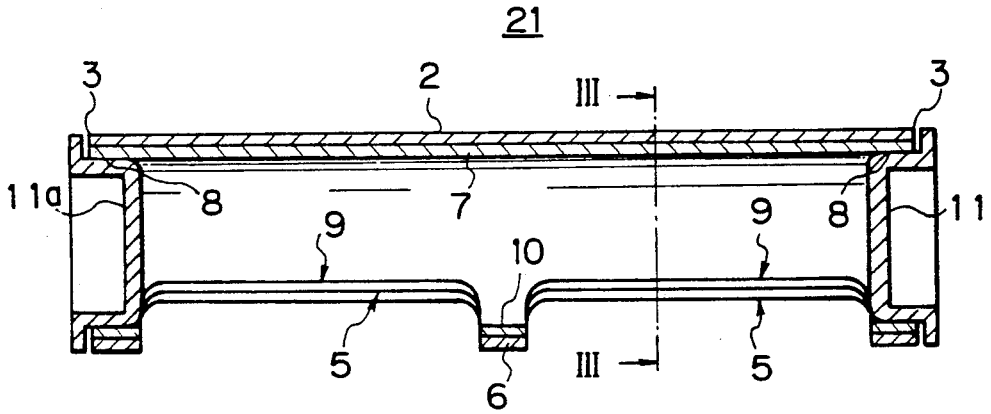
Fig. 11 PRIOR ART
FIG. 11 is a longitudinal sectional view illustrating a completely open state of the conventional cartridge.
Figure 12:
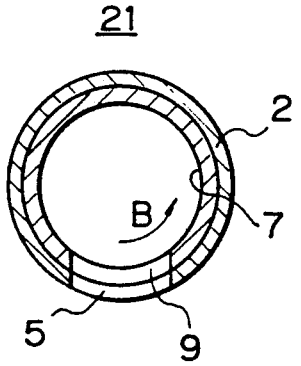
Fig. 12 PRIOR ART
FIG. 12 is a cross-sectional view taken on line III—III of FIG. 11.

Furthermore, as shown in FIG. 7, it is also possible for the edges 5*a* of the outer cylinder toner discharge openings 5 at the circumferential side for sealing the toner to be formed at angles to the axial direction and to edges 9*a* of the inner cylinder toner discharge openings 9. According to such an arrangement, when the inner cylinder toner discharge openings are closed by rotating the inner cylinder 7 relative to the outer cylinder 2, each edge 5*a* of the outer cylinder toner discharge openings 5 slides relative to a edge 9*a* of the inner cylinder toner discharge opening 9 at a single point of contact only. Thus, it also is possible to avoid such a situation that the edges 5*a* and 9*a* meet linearly. Thereby, the inner cylinder 7 smoothly slides relative to the outer cylinder 2 so that the inner cylinder toner discharge openings 9 smoothly are closed.

According to the present invention as described above, the toner cartridge is arranged such that opposite ends of the outer cylinder are provided with notches, the outer cylinder toner discharge openings are separated by a single or a plurality of outer cylinder ribs, and the inner cylinder toner discharge openings are separated by a single or a plurality of inner cylinder ribs, and the inner and outer cylinder ribs are not axially aligned with each other. This arrangement makes it possible to avoid such a situation that an outer peripheral surface of the inner cylinder and an inner peripheral surface of the outer cylinder, other than at opposite ends, are in sliding contact over their entire peripheries. Further, it is possible to absorb a deformation of the inner cylinder in the outward direction by the outer cylinder toner discharge openings and the notches, and also it is possible to absorb a deformation of the outer cylinder in the inward direction by the inner cylinder toner discharge openings. Thus, according to the present invention, it is possible to achieve smooth sliding of the inner cylinder relative to the outer cylinder.

Further, the toner cartridge according to the present invention is so arranged that edges of the inner cylinder toner discharge openings extend at angles to edges of the outer cylinder toner discharge openings. This arrangement makes it possible to avoid such a situation that when the inner cylinder toner discharge openings are closed, the edges of the inner cylinder toner discharge openings are fully aligned with the edges of the outer cylinder toner discharge openings. Thus according this feature of the present invention, it further is possible to smoothly slide the inner cylinder relative to the outer cylinder.

While the present invention has been described with reference to the particular illustrative embodiments, the scope of the invention is not restricted by such embodiments but only by the appended claims. It is to be appreciated that those skilled in the art will be able to change or modify the specifically disclosed embodiments without departing from the scope and spirit of the present invention.

What is claimed is:

1. A toner cartridge comprising:

a generally cylindrical and hollow outer cylinder having a peripheral surface in which are formed outer cylinder toner discharge openings extending in a longitudinal direction of said outer cylinder;

said outer cylinder having respective apertures at opposite ends thereof;

a generally cylindrical inner cylinder contained within said outer cylinder in such a relation that it is adjacent to said outer cylinder and is rotatably slidable relative thereto, said inner cylinder having a cavity in which toner may be contained;

said inner cylinder having respective apertures at opposite ends thereof;

covers positioned within respective said inner cylinder apertures;

said inner cylinder having a peripheral surface in which are formed inner cylinder toner discharge openings extending in a longitudinal direction of said inner cylinder and in communication with said cavity, said inner cylinder toner discharge openings being alignable with said outer cylinder toner discharge openings;

opposite ends of said outer cylinder having notches formed therein;

said outer cylinder toner discharge openings being axially spaced by a single or a plurality of outer cylinder ribs; and said inner cylinder toner discharge openings being axially spaced by a single or a plurality of inner cylinder ribs that are not axially aligned with said outer cylinder ribs.

2. A toner cartridge according to claim 1, wherein an edge of each said inner cylinder toner discharge opening is formed at an angle with an edge portion of a respective said outer cylinder toner discharge opening.

3. A toner cartridge according to claim 2, wherein each said inner toner discharge opening is generally rectangular.

4. A toner cartridge according to claim 2, wherein each said outer toner discharge opening is generally rectangular.

5. A toner cartridge comprising:

a generally cylindrical and hollow outer cylinder having a peripheral surface in which are formed outer cylinder toner discharge openings extending in a longitudinal direction of said outer cylinder;

an inner cylinder contained within said outer cylinder in such a relation that it is adjacent to said outer cylinder and rotatably slidable relative thereto, said inner cylinder having a cavity in which toner may be contained;

said inner cylinder having a peripheral surface in which are formed inner cylinder toner discharge openings extending in a longitudinal direction of said inner cylinder and in communication with said cavity, said inner cylinder toner discharge openings being alignable with said outer cylinder toner discharge openings;

said outer cylinder toner discharge openings being axially spaced by at least one outer cylinder rib; and said inner cylinder toner discharge openings being axially spaced by at least one inner cylinder rib that is not axially aligned with said outer cylinder rib.

6. A toner cartridge according to claim 5, wherein an edge of each said inner cylinder toner discharge opening is formed at an angle with an edge of a respective said outer cylinder toner discharge opening.

7. A toner cartridge according to claim 6, wherein each said inner toner discharge opening is generally rectangular.

8. A toner cartridge according to claim 6, wherein each said outer toner discharge opening is generally rectangular.

9. A toner cartridge comprising:

a generally cylindrical and hollow outer cylinder having a peripheral surface in which is formed at least one outer cylinder toner discharge opening extending in a longitudinal direction of said outer cylinder;

said outer cylinder having respective apertures at opposite ends thereof;

a generally cylindrical inner cylinder contained within said outer cylinder in such a relation that it is adjacent to said outer cylinder and is rotatably slidable relative thereto, said inner cylinder having a cavity in which toner may be contained;

said inner cylinder having respective apertures at opposite ends thereof;

covers positioned within respective said inner cylinder apertures;

said inner cylinder having a peripheral surface in which is formed at least one inner cylinder toner discharge opening extending in a longitudinal direction of said inner cylinder and in communication with said cavity, said inner cylinder toner discharge opening being alignable with said outer cylinder toner discharge opening; and opposite ends of said outer cylinder having formed therein notches that are open at respective said opposite ends.

10. A toner cartridge according to claim 9, comprising a plurality of said notches formed in each said opposite end of said outer cylinder.

11. A toner cartridge according to claim 9, wherein an edge of said inner cylinder toner discharge opening is formed at an angle with an edge of said outer cylinder toner discharge opening.

12. A toner cartridge according to claim 11, wherein said inner toner discharge opening is generally rectangular.

13. A toner cartridge according to claim 11, wherein said outer toner discharge opening is generally rectangular.

14. A toner cartridge comprising:

a generally cylindrical and hollow outer cylinder having a peripheral surface in which is formed at least one outer cylinder toner discharge opening extending in a longitudinal direction of said outer cylinder;

said outer cylinder having respective apertures at opposite ends thereof;

a generally cylindrical inner cylinder contained within said outer cylinder in such a relation that it is adjacent to said outer cylinder and is rotatably slidable relative thereto, said inner cylinder having a cavity in which toner may be contained;

said inner cylinders having respective apertures at opposite ends thereof;

covers positioned within respective said inner cylinder apertures;

said inner cylinder having a peripheral surface in which is formed at least one inner cylinder toner discharge opening extending in a longitudinal direction of said inner cylinder and in communication with said cavity, said inner cylinder toner discharge opening being alignable with said outer cylinder toner discharge opening; and an edge of said inner cylinder toner discharge opening being formed at an angle with an edge of said outer cylinder toner discharge opening.

15. A toner cartridge according to claim 14, wherein said inner toner discharge opening is generally rectangular.

16. A toner cartridge according to claim 14, wherein said outer toner discharge opening is generally rectangular.

* * * * *